US005363827A

United States Patent [19]

Siekmann

[11] Patent Number: 5,363,827

[45] Date of Patent: Nov. 15, 1994

[54] FUEL PUMP ASSEMBLY

[75] Inventor: James M. Siekmann, Crystal City, Mo.

[73] Assignee: Carter Automotive Company, Inc., Southfield, Mich.

[21] Appl. No.: 136,526

[22] Filed: Oct. 14, 1993

[51] Int. Cl.[5] ..... F02M 37/04; E03B 11/00

[52] U.S. Cl. ..... 123/509; 123/572

[58] Field of Search ..... 123/509, 514, 510, 516; 137/571, 572, 575, 576, 578

[56] References Cited

U.S. PATENT DOCUMENTS

| | | | |
|---|---|---|---|
| 4,807,582 | 2/1989 | Tuckey | 137/572 |
| 4,971,017 | 11/1990 | Beakley | 123/509 |
| 4,974,570 | 12/1990 | Szwargulski | 137/572 |
| 5,050,567 | 9/1991 | Suzuki | 123/509 |
| 5,058,577 | 10/1991 | Frank | 123/509 |
| 5,170,764 | 12/1992 | Tuckey | 123/509 |
| 5,218,942 | 6/1993 | Coha | 137/576 |
| 5,237,977 | 8/1993 | Tuckey | 123/510 |

*Primary Examiner*—Carl S. Miller
*Attorney, Agent, or Firm*—Lawrence J. Shurupoff

[57] ABSTRACT

An engine fuel system includes a fuel pump located within an upright reserve fuel container located in a fuel tank. Fuel is admitted to the inlet chamber of the pump through separate poppet valves associated with the fuel tank and the reserve fuel container. The container is a sealed construction that isolates the fuel in the container from the fuel in the tank. The poppet valve leading from the tank to the pump is operated by a float that is responsive to the fuel level in the tank. At low tank fuel levels (empty or near empty), the float-operated poppet valve is closed. The two valves are interconnected by a lost motion connection such that the poppet valve associated with the reserve container is openable by pressures generated in the return fuel line, or by suction forces generated by the fuel pump. The reserve container is maintained in a filled condition ready for supplying fuel to the pump when the fuel tank is in a near empty condition.

16 Claims, 2 Drawing Sheets

FIG 2
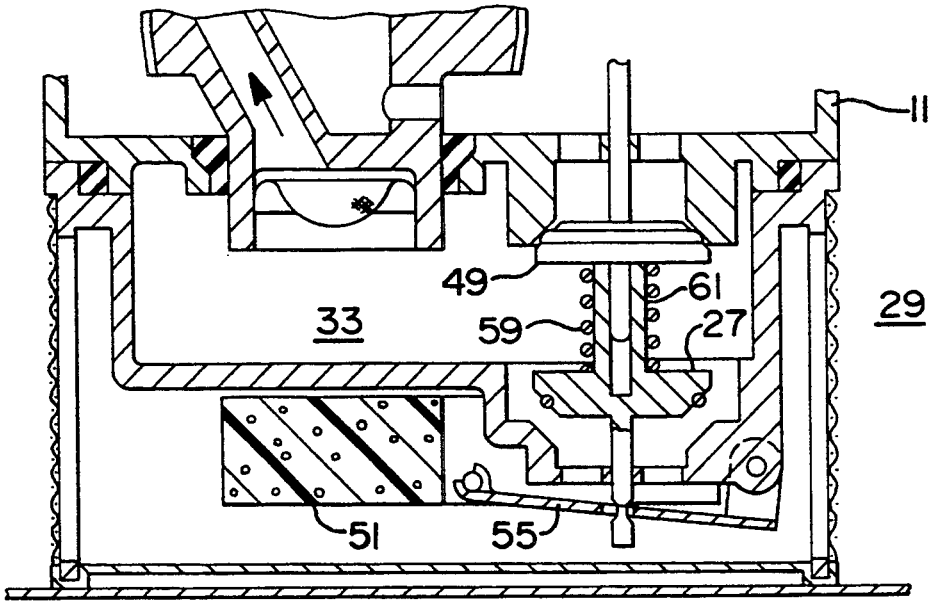
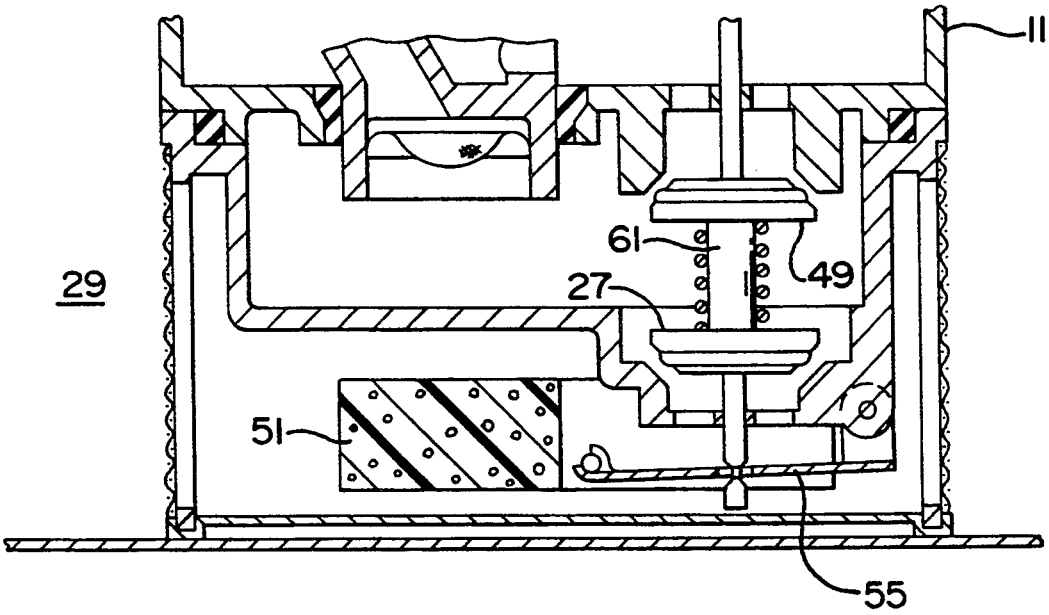
FIG 3

FUEL PUMP ASSEMBLY

BACKGROUND OF THE INVENTION

1. Field of the Invention

This invention relates to vehicle engine fuel supply systems and, particularly, to a fuel supply system having a reserve fuel container and fuel pump located within the vehicle fuel tank.

2. Description of Prior Developments

It is known to provide a fuel container in a vehicle fuel tank for supplying fuel to a fuel pump when the tank is essentially empty, or when the fuel in the tank is sloshing or thrown away from the pump inlet chamber due to vehicle turning maneuvers.

U.S. Pat. No. 4,974,570 to Szwargulski shows a reserve fuel supply system that includes a pressure responsive valve for conveying fuel from a reserve container to the fuel pump when a float valve in the tank closes due to lack of fuel in the tank. The reserve fuel container has an open top such that fuel vapors associated with heated fuel can circulate between the reserve container and the surrounding space in the fuel tank.

Conventional engine fuel systems have fuel pumps that are sized to deliver more fuel than the engine can use. Excess fuel not used by the engine is returned to the fuel tank via a return line. The excess fuel is usually heated as a result of its travel through the engine fuel injectors or other heated passageways. Consequently, the returned fuel tends to heat the fuel in the tank.

Under some conditions, fuel vapors from the heated fuel can form in the tank to such an extent that, when the motorist opens the gas cap on the tank to add fuel, the accumulated vapors can escape into the ambient atmosphere. Such vapor escape represents an air pollution problem that the present invention is designed to reduce.

Fuel supply systems having reserve fuel containers within the fuel tanks are disclosed in various patents, e.g., U.S. Pat. Nos. 3,443,519; 4,672,937; 4,747,388; 4,776,315; 4,807,582; and 4,831,990. It is not believed that any of these patent disclosures address the problem of fuel vapor accumulation and vapor escape from the fuel tank.

SUMMARY OF THE INVENTION

The present invention is directed to an automotive engine fuel supply system that includes a reserve fuel container located within a conventional fuel tank, such that excess fuel not used by the engine is returned only to the reserve fuel container where it is isolated from the main body of fuel in the tank. A system of valves is provided so that the fuel pump normally draws its fuel supply partly from the tank and partly from the reserve container.

Part of the fuel supplied to the pump is in a heated condition due to its having come from the reserve container instead of from the fuel tank. Therefore, since the returned fuel from the engine is continually being recycled through the fuel pump, the general temperature of the fuel in the tank is kept relatively low, such that vapor generation is reduced. Also, most of the vapors that are produced are confined to the reserve container or are carried away by the fuel pump. As a result of these factors, there is a lessened potential for fuel vapor escape when the tank filler cap is opened for adding fuel to the tank.

In a preferred arrangement, the fuel tank is connected to the fuel pump via a float-operated poppet valve located below the reserve fuel container and in open communication with the pump inlet chamber. The reserve fuel container has a second poppet valve axially aligned with the first mentioned poppet valve, with both valves being adapted to feed fuel to the pump inlet chamber.

A lost motion connection is provided between the two poppet valves, whereby the valves can be selectively opened and closed depending on the condition of the float and fuel levels in the tank and reserve container. The system is designed to minimize the formation or accumulation of fuel vapors in the fuel tank from heated fuel and provides a reserve fuel supply for the fuel pump when the tank is in a near empty condition that would otherwise deprive the pump of fuel.

BRIEF DESCRIPTION OF THE DRAWINGS

In the drawings:

FIG. 2 is a fragmentary view taken in the same direction as FIG. 1, but showing the valve assembly in a different operational mode.

FIG. 3 is a fragmentary view taken in the same direction as FIG. 1, but showing the valve assembly in another operational mode.

DETAILED DESCRIPTION OF THE PREFERRED EMBODIMENTS

Figure 1:
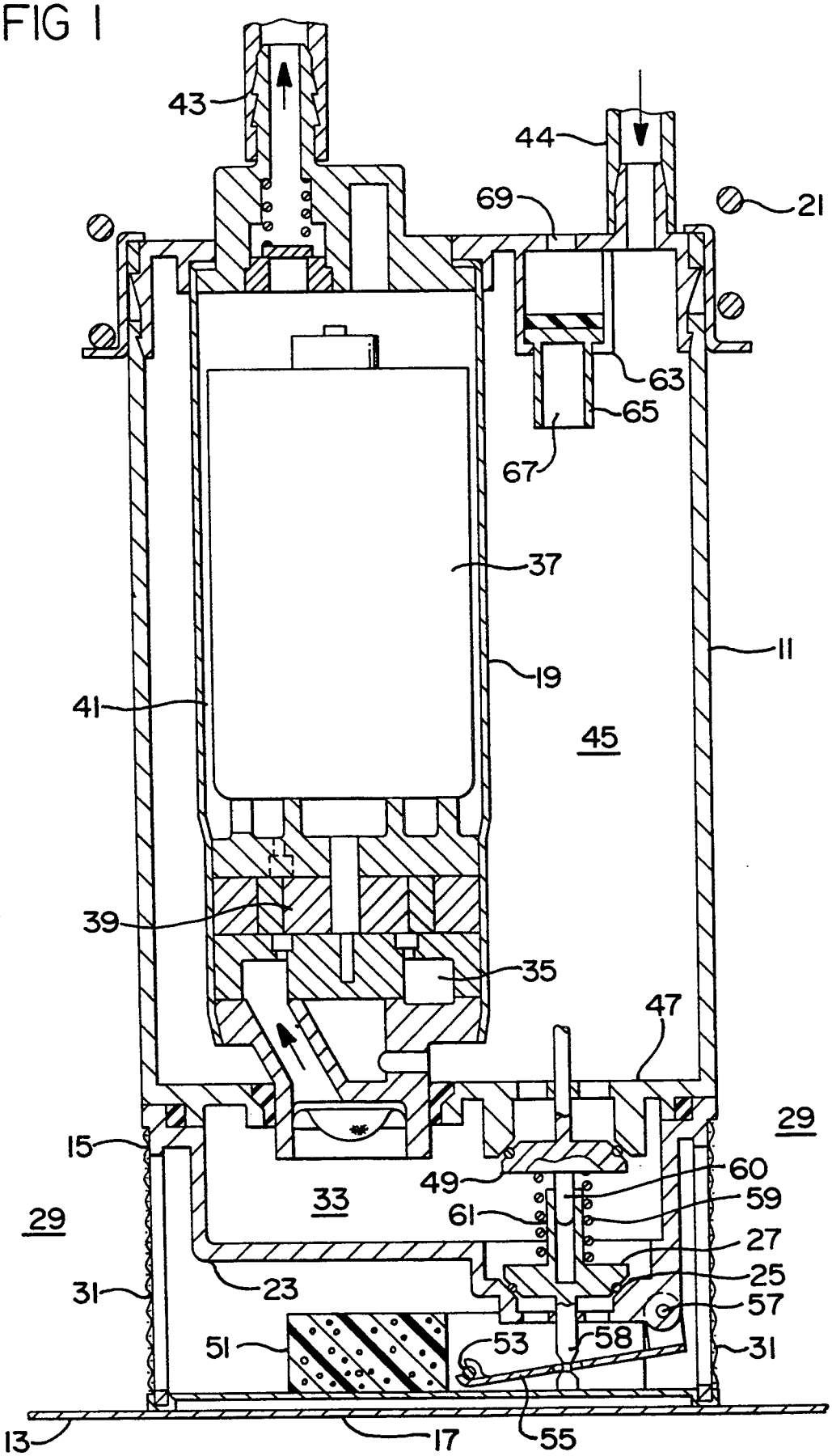
FIG. 1 is a sectional view taken through a reserve fuel container and control valve assembly used in an engine fuel supply system in accordance with the present invention.

The engine fuel system shown in FIG. 1 includes an upright cylindrical fuel container 11 positioned within a fuel tank 13. The container includes a hollow partitioned base structure 15 that seats on the bottom wall 17 of the fuel tank. The top wall of the fuel tank (not shown) has an access opening therein for the purpose of installing the fuel container into the tank.

After the container has been inserted downwardly through the access opening, a cover (not shown) is mounted over the access opening. The cover has fittings and electrical connections for fuel lines and wiring associated with a fuel pump 19 located within container 11. A coil spring 21 can be positioned between container 11 and the cover to firmly position the container within the fuel tank. The overall installation may be similar to that depicted in U.S. Pat. No. 4,974,570.

Base structure 15 includes an internal partition 23 that forms a valve opening 25. Seated on the valve opening is a poppet valve 27. Fuel can flow freely from the fuel tank space 29 through a filter screen 31 into the space below poppet valve 27. When the valve is open, as shown in FIGS. 2 and 3, the fuel can flow upwardly through the valve opening 25 into an internal chamber 33 that is in open communication with the inlet chamber 35 of fuel pump 19.

Fuel pump 19 may be a gear pump constructed as shown in U.S. Pat. No. 4,820,138 to Bollinger. The pump includes an electric motor 37 that drives an external gear 39, whereby liquid fuel is pumped upwardly into an annular space 41 and through motor 37 for motor cooling and eventually into a fuel line 43 going to the engine.

The quantity of fuel delivered by the pump is greater than the quantity required by the engine. Excess or unused fuel is returned to fuel container 11 through a return line 44 where it collects in the container space 45. All of the returned fuel goes into container 11, effectively none goes back to the fuel tank.

A lower wall 47 of the fuel container has a valve opening or valve seat that receives a poppet valve 49. When poppet valve 49 is open, as shown in FIG. 3, fuel can flow downwardly from container space 45 into chamber 33. FIG. 3 shows one condition wherein both poppet valves 27,49 are open. The fuel pump then draws fuel from the fuel tank and from container 11.

FIG. 2 shows a second condition wherein poppet valve 49 is closed and poppet valve 27 is open. The fuel pump then draws fuel solely from the fuel tank space 29 through valve 27. There is a third condition (not shown) wherein valve 49 is open and valve 27 is closed. The pump then draws fuel solely from container 11 through valve 49. Valve 27 is referred to as a lower valve, and valve 49 is referred to as an upper valve. The two valves are vertically aligned on a common movement axis.

Valve 27 is opened and closed by a buoyant float member 51 that has a generally C-shaped configuration in top plan view. A horizontal pivot pin 53 extends through the float member 51 and across the space within the C-shaped float member for connection with a lever arm 55. The lever arm is swingable in a vertical arc around a fixed pivot axis 57, whereby the float member 51 is enabled to move vertically up or down depending partly on the quantity of fuel in tank 13 and the degree to which the fuel might be sloshing back and forth in the tank. Pivot pin 53 enables float member 51 to maintain a level attitude throughout its vertical stroke.

FIG. 1 shows float member 51 in a lowered position produced by an empty tank or by a tank fuel level less than the predetermined value required for normal operation of the fuel pump. FIG. 2 shows float member 51 in a raised position produced by higher than minimum fuel levels in the tank. FIGS. 1 and 2 represent the limits of the float member stroke.

Poppet valve 27 has a stem 58 that has a pivot connection with lever arm 55. A neck portion of the stem extends within a slot in arm 55, whereby arcuate motion of the arm translates into vertical motion of the poppet valve.

The two poppet valves 27 and 49 are interconnected by a lost motion connection that includes a coil spring 59 and a hollow sleeve-like rod 61. As shown, hollow rod or tube 61 extends upwardly from poppet valve 27 for slidable motion on a pin 60 that extends downwardly from poppet valve 49, whereby the two poppet valves have relatively good axial and radial alignments with the associated valve seats. The length of rod 61 is less than the spacing between valves 27 and 49 when the valves are in their closed positions as shown in FIG. 1.

Coil spring 59 exerts an upward biasing force on poppet valve 49 and a downward biasing force on poppet valve 27. The force of spring 59 is less than the upward buoyant force developed by float member 51 such that the float member is enabled to lift poppet valve 27 to an open condition, as shown in FIG. 2.

Referring to FIG. 1, container 11 has a cage structure 63 depending from its upper wall 64 for slidably supporting a closure means such as float valve 65. Valve 65 has a cup shape that forms an air chamber 67 when the fuel level rises in container space 45 to a point where it reaches the lower edge of the cup. A rising fuel level in container space 45 lifts valve 65 so that it seals a vent opening 69 in container wall 64. When the fuel level in the container is lowered, the float valve 65 returns to the open position as shown.

Float valve 65 could also take the form of a dynamic flow valve which remains open for vapor flow when container space 45 is filling, but closes when liquid tries to flow past it.

The spring force of spring 59 is sufficient to support the head of liquid in container 11 until the container is completely filled, i.e. until vent opening 69 is closed by valve closure means 65. However, when vent opening 69 is closed, continued flow of fuel through return line 44 toward container 11 produces a pressure in line 44 that slightly pressurizes the container space 45. Such pressure is sufficient to open the upper poppet valve 49 for feeding the pump 19 with fuel from container 11 as depicted in FIG. 3.

The above discussion on the force of spring 59, and the action of poppet valve 49, is somewhat simplified in that it does not take into account the suction force produced by the fuel pump, i.e. the suction condition existing in chamber 33. Under some conditions, valve 49 will be open even when container space 45 is at atmospheric pressure.

Referring to the general operation of the illustrated system, FIG. 1 represents the condition of an empty fuel tank with essentially no fuel in tank space 29 or container space 45. As new fuel is added to the tank, float member 51 will be lifted to the FIG. 2 position wherein poppet valve 49 is opened by the buoyant force of the float member. Hollow rod 61 is of such a length that poppet valve 27 can move up to the open position without disturbing valve 49. If sufficient fuel is added to the tank, some of the fuel may enter container 11 through the vent opening 69. The addition of fuel into container 11 is, however, not necessary for operation of fuel pump 19. The pump can draw fuel from tank space 29 through the open poppet valve 27.

FIG. 2 represents the operating condition when there is an adequate supply of fuel in tank space 29 and less than a complete filling of container 11. During normal operation of the fuel pump, excess or unused fuel returns from the engine through return line 44 such that, after a period of operation, container 11 is completely filled. Float valve 65 then seals vent opening 69 such that continued return of fuel slightly pressurizes the fuel in container space 45.

FIG. 3 represents the condition of poppet valves 27 and 49 during normal operation of the fuel pump with container space 45 slightly pressurized. The force of the liquid fuel on the upper face of poppet valve 49 causes valve 49 to open such that the valve assembly moves slightly downwardly to the FIG. 3 condition. The fuel pump is then drawing fuel from the tank through valve 27 and also from container 11 through valve 49. The valve assembly may reciprocate slightly depending on fuel demand by the engine.

As the fuel level in tank 13 gradually lowers due to consumption of fuel by the engine, there comes a time when the tank fuel level falls below the level required to keep float member 51 in a buoyant condition. Due to fuel sloshing back and forth in the tank or due to the absence of fuel in the tank, the float member will gravitate to the FIG. 1 condition, wherein valve 27 is closed. However, the upper poppet valve 49 will remain in the open condition until container 11 is essentially emptied of fuel.

With valve 27 closed and container 11 having a reserve fuel supply in space 45, the pump suction force in chamber 33 has an increased effect on valve 49. Also, float member 51 exerts no buoyant force on the poppet valve assembly because the float member is deprived of the fuel that produces the buoyant condition. The float member 51 will exert a downward force on valve 27, thereby allowing the pump to pull fuel through valve 49 when no fuel is around float member 51. Pump suction force in chamber 33, together with the liquid head in container 11 and downward force exerted on valve 27 by float member 51, overcomes the force of spring 59 whereby valve 49 is open until and after container 11 is in an essentially empty condition.

The illustrated fuel supply system achieves several purposes. During normal pump operation, reserve container 11 is maintained in a filled condition and is thus able to supply reserve fuel to the pump when the tank is in a near empty condition or when fuel is sloshing back and forth in the tank.

During normal operations (FIG. 3), the pump is drawing an appreciable portion of its fuel supply from container 11 through valve 49. The fuel returning from the engine is somewhat hotter than the fuel in tank space 29. Vapor pressure increases are confined to the fuel in container 11 so that the fuel in tank space 29 is relatively cool and vapor-free. There is thus a lessened potential for fuel vapors to escape from the tank into the atmosphere when the motorist opens the gas tank cap to refill the tank.

The valve assembly of the present invention has, as a principal objective, the minimization of fuel vapor emission from the fuel tank into the atmosphere through the opened gas tank cap. This objective is achieved without sacrificing the feature of having a reserve fuel supply that prevents pump inoperability due to an insufficient fuel supply.

What is claimed is:

1. A fuel supply system for an engine, comprising:

a fuel container positionable in a fuel tank;

a fuel pump for supplying fuel to an engine, the fuel pump having an inlet chamber selectively communicating with the fuel tank and the fuel container;

a return line connected to the fuel container for returning unused fuel to the fuel container;

an upper valve for controlling fuel flow from the fuel container to the pump inlet chamber;

a lower valve for controlling fuel flow from the fuel tank to the pump inlet chamber:

float means for opening the lower valve when the fuel level in the tank is above a predetermined minimum value; and lost motion means interconnecting the lower valve and the upper valve.

2. The fuel supply system of claim 1, wherein the lost motion means comprises a spring biasing the upper valve to a closed position.

3. The fuel supply system of claim 1, wherein the lost motion means comprises a spring trained between the lower valve and the upper valve.

4. The fuel supply system of claim i, wherein the lost motion means comprises a coil spring trained between the lower valve and the upper valve, so that the spring exerts an upward biasing action on the upper valve and a downward biasing action on the lower valve.

5. The fuel supply system of claim 4, wherein each said valve is a poppet valve.

6. The fuel supply system of claim 1, wherein the lost motion means comprises an elongated rod means extending axially from one of the valves toward the other valve, the rod means having a lesser length than the spacing between the valves when the valves are closed.

7. The fuel supply system of claim 6, wherein the lost motion means comprises a coil spring trained between the lower valve and the upper valve, whereby the spring exerts an upward biasing action on the upper valve and a downward biasing action on the lower valve.

8. The fuel system of claim 7, wherein the coil spring encircles the rod means.

9. The fuel system of claim 1, wherein the upper valve is a poppet valve having a lower face exposed to pump inlet chamber suction forces, whereby the upper valve is drawn downwardly to an open position when the float means is in a nonbuoyant condition resulting from a tank fuel level less than the predetermined minimum value.

10. The fuel supply system of claim 1, wherein the fuel pump is located within the container.

11. The fuel supply system of claim 1, wherein the upright container has a vent opening communicating with the fuel tank and means for automatically closing the vent opening when the container is substantially filled with fuel, whereby fuel vapors are then trapped within the container.

12. The fuel supply system of claim 1, wherein the float means comprises a lever arm swingable in a vertical arc around a fixed pivot axis and a buoyant float member having a pivotal connection with the lever arm; the lower valve being connected to the lever arm so that vertical motion of the float member produces a vertical movement of the lower valve.

13. The fuel supply system of claim I, wherein the lost motion means comprises a coil spring trained between the lower valve and the upper valve; the spring developing a lesser force than the buoyant force developed by the float means.

14. A fuel supply system for an engine, comprising:

a fuel container positionable in a fuel tank;

an excess fuel line connected to said container for returning unused fuel to said container;

a fuel pump for supplying fuel to an engine, said fuel pump having an inlet chamber communicating with said fuel tank and said container;

a first valve for controlling fuel flow from said container to said pump inlet chamber;

a second valve for controlling fuel flow from said tank to said pump inlet chamber; and means for operating said valves so that, when the fuel level in said tank is below a predetermined minimum value, said second valve is closed and said first valve is open; and, when the tank fuel level is above said predetermined minimum value and said container is filled with fuel, both valves are open whereby said pump inlet chamber then receives fuel from both said tank and said container.

15. The supply system of claim 14, wherein said operating means comprises a float means connected with said second valve and a spring trained between said first valve and said second valve.

16. The fuel supply system of claim 15, wherein said spring is a coil spring coaxial with said first and second valves.

* * * * *